US007641188B2

(12) United States Patent
Hiura et al.

(10) Patent No.: US 7,641,188 B2
(45) Date of Patent: Jan. 5, 2010

(54) SHEET FEEDING APPARATUS AND IMAGE FORMING APPARATUS

(75) Inventors: Hiroshi Hiura, Toride (JP); Takeshi Suga, Moriya (JP); Toshifumi Itabashi, Toride (JP); Hajime Sekiguchi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/102,349

(22) Filed: Apr. 14, 2008

(65) Prior Publication Data

US 2008/0265488 A1 Oct. 30, 2008

(30) Foreign Application Priority Data

Apr. 24, 2007 (JP) ..... 2007-114870

(51) Int. Cl.
*B65H 3/52* (2006.01)

(52) U.S. Cl. ..... 271/122; 271/125; 271/208

(58) Field of Classification Search ..... 271/122, 271/125, 208

See application file for complete search history.

(56) References Cited

U.S. PATENT DOCUMENTS 2,828,123 A * 3/1958 Guillemette ..... 226/94
3,771,783 A * 11/1973 McInerny ..... 271/125
3,857,559 A * 12/1974 McInerny ..... 271/122
4,561,644 A * 12/1985 Clausing ..... 271/34
5,195,736 A * 3/1993 Ishidate ..... 271/22
5,678,127 A 10/1997 Suga ..... 399/45
6,059,285 A 5/2000 Suga et al. ..... 271/228
6,260,840 B1 7/2001 Suga et al. ..... 271/10.12
6,378,858 B1 4/2002 Suga ..... 271/10.01
6,913,257 B2 * 7/2005 Takaki et al. ..... 271/125
7,234,695 B2 * 6/2007 Tsukamoto et al. ..... 271/122
2002/0020959 A1 * 2/2002 Matsuda et al. ..... 271/122
2006/0180990 A1 * 8/2006 Ueda et al. ..... 271/121

FOREIGN PATENT DOCUMENTS

JP 62016953 A * 1/1987
JP 62140947 A * 6/1987
JP 5-338837 12/1993

* cited by examiner

*Primary Examiner*—David H Bollinger
(74) *Attorney, Agent, or Firm*—Fitzpatrick, Cella, Harper & Scinto

(57) ABSTRACT

Sheets fed out of a cassette supporting the sheets by a pickup roller are separated and fed by a sheet separation feeding unit having a feed roller and a separating roller which is rotatable in a direction opposite to a sheet feeding direction. A charge eliminating mechanism for eliminating charges of the separating roller is arranged on the upstream side in the sheet feeding direction in a separation nip portion between the feed roller and the separating roller.

10 Claims, 15 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus and, more particularly, to a construction of a separation feeding unit for separating and feeding sheets one by one to an image forming unit.

2. Description of the Related Art

Hitherto, an image forming apparatus such as copying apparatus, printer, or facsimile has a sheet feeding apparatus for feeding a sheet to an image forming unit, and the sheet feeding apparatus has a sheet separation feeding unit for separating and feeding the sheets one by one.

As such a sheet separation feeding unit, there is a sheet separation feeding unit having a feed roller and a retard roller (separating roller) which is come into pressure contact with the feed roller and to which a rotating force in the direction opposite to a sheet feeding direction is applied through a torque limiter. In the sheet separation feeding unit of such a retard separating system, the sheets are separated one by one by the operation of the torque limiter.

FIG. 10 is a diagram illustrating a construction of the sheet feeding apparatus in the related art having the sheet separation feeding unit of such a retard separating system. FIG. 10 illustrates a cassette 200 in which sheets S are stored (supported), a side wall 203 on the downstream side in the sheet feeding direction of the cassette 200, and a middle plate 201 provided for the cassette 200 so as to be movable in the vertical direction. The sheets S have been stacked on the middle plate 201.

A pickup roller 129 feeds a top sheet Sa among the sheets S enclosed in the cassette 200. A feed roller 130 is made of, for example, urethane. A retard roller 131 is made of, for example, EPDM and is come into pressure contact with the feed roller 130 by a spring (not shown). When the retard roller 131 is come into pressure contact with the feed roller 130, a separation nip portion N is formed between the retard roller 131 and the feed roller 130 and a surface portion of the retard roller 131 which is in contact with the feed roller 130 is compressed.

The top sheet Sa fed out by the pickup roller 129 is conveyed to the separation nip portion N formed by the feed roller 130 and the retard roller 131.

A sheet feeding frame 301 holds a spring (not shown) adapted to allow the retard roller 131 to be come into pressure contact with the feed roller 130. A conveying path 303 is formed by a conveying guide 302 provided between the separation nip portion N and a pair of conveying rollers 305*a* and 305*b*. A detecting sensor flag 304 detects a passage of the sheet S.

In the sheet feeding apparatus in the related art constructed as mentioned above, in the case of feeding the sheets, first, the pickup roller 129 rotates and the top sheet Sa supported in the cassette 200 is conveyed to the separation nip portion N.

As a sheet Sa fed to the separation nip portion N, in the case where only one sheet has been conveyed to the separation nip portion N, the retard roller 131 is driven by the sheet Sa by the operation of the torque limiter as illustrated in FIG. 11. Thus, the sheet Sa passes along the conveying path 303.

If a plurality of sheets has been conveyed to the separation nip portion N, the retard roller 131 is rotated in the direction opposite to the sheet feeding direction of the feed roller 130 by the operation of the torque limiter as illustrated in FIG. 12 without being driven by the feed roller 130. Since the retard roller 131 is rotated in the direction opposite to the sheet feeding direction of the feed roller 130 as mentioned above, only one sheet Sa which is in contact with the feed roller 130 is conveyed and the other sheets are returned to the upstream side in the sheet feeding direction by the retard roller 131.

In such a sheet feeding apparatus in the related art, there is a case where the surface of the retard roller 131 is scraped due to deterioration in durability or the surface of the retard roller 131 is charged by a slide friction between the retard roller 131 and the conveyed sheet S. When the surface is charged, a foreign matter (mainly, paper powder generated from the sheet) is deposited onto the surface of the retard roller 131 and a coefficient of friction of the surface of the retard roller 131 decreases.

Ordinarily, the retard roller 131 has halted by a friction caused by the pressure contact with the feed roller 130 when the feed roller 130 has been stopped. When the feed roller 130 starts to rotate, the retard roller 131 rotates in the sheet conveying direction synchronously with the rotation of the feed roller 130. However, when the coefficient of friction of the surface decreases, the retard roller 131 starts to rotate in such a direction as to return the sheet in the direction opposite to the sheet feeding direction of the feed roller 130 irrespective of the stop/rotation of the feed roller 130.

That is, inherently, the retard roller 131 rotates in the reverse direction in the case where a plurality of sheets has been conveyed to the separation nip portion N as mentioned above. However, when the coefficient of friction of the surface decreases, even in the case of feeding one sheet, the retard roller 131 rotates in the direction opposite to the rotating direction adapted to feed the sheet.

When the retard roller 131 rotates in the direction opposite to the rotating direction adapted to feed the sheet, the following problems occur. When the sheet Sa fed out by the pickup roller 129 collides with the retard roller 131 as illustrated in FIG. 13, a sheet front edge is rolled in by the retard roller 131 as illustrated in FIG. 14 and there is a risk of occurrence of a defective feeding state where the front edge is bent.

Further, if the sheet S is curled toward the retard roller 131 side, the defective feeding of the bent front edge is more liable to occur. Since the sheet front edge collides with the surface of the retard roller 131, a scratch occurs on the surface of the retard roller 131 and the defective feeding is further liable to occur.

To prevent such a drawback, in the sheet feeding apparatus having the sheet separation feeding unit of the retard separating system, a guide is provided at a front edge in the sheet feeding direction of the cassette. The sheet fed out by the feed roller 130 is guided to the separation nip portion N by the guide. By guiding the sheet toward the separation nip portion N by the guide, it is prevented that the sheet front edge is rolled in by the retard roller 131.

As such a guide, for example, there is a guide arranged in such a manner that one end is supported to a fixing portion of a sheet conveying path and the other end is extended to a position near the separation nip portion from an almost tangential direction of an outer surface of the retard roller 131. Such a construction has been disclosed in Japanese Patent Application Laid-Open No. H05-338837.

FIG. 15 is a diagram illustrating a construction of the sheet feeding apparatus in the related art having such a guide. A sheet guide 135 is made of a thin elastic member and is in elastically come into contact with the outer surface of the retard roller 131 from its almost tangential direction.

By allowing the sheet guide 135 to be come into contact with the outer surface of the retard roller, the sheet front edge can sufficiently reach the position near the separation nip portion N without colliding with the retard roller 131. Thus, even when the retard roller 131 is rotated in the direction opposite to the sheet feeding direction, it is possible to prevent such an inconvenience that the sheet is rolled in by the retard roller 131 and the occurrence of the damage on the surface of the retard roller 131.

In the sheet feeding apparatus in the related art, as already mentioned above, the surface of the retard roller 131 is scraped due to the deterioration in durability or the surface of the retard roller 131 is charged by the slide friction with the conveyed sheet S.

If the foreign substance such as a paper powder is deposited onto the surface of the retard roller 131 by a surface charging and the coefficient of friction of the surface of the retard roller 131 decreases, the rotation in the direction opposite to the sheet feeding direction of the retard roller 131 as mentioned above is caused. Particularly, in the case of using such a sheet that the paper powder is liable to be generated, the coefficient of friction decreases rapidly due to a large quantity of paper powder deposited on the surface and the rotation in the reverse direction of the retard roller 131 is caused early. Thus, the sheets cannot be stably separated and fed.

The sheet guide 135 illustrated in FIG. 15 can be constructed in such a manner that even in the case where the retard roller 131 is rotated in the reverse direction, the front edge of the sheet is not come into contact with the retard roller 131 as much as possible. However, the rotation in the reverse direction of the retard roller 131 cannot be prevented. Therefore, even if the sheet guide 135 has been arranged, there is a large risk that the front edge of the sheet is come into contact with the retard roller 131 which is reversely rotated and the foregoing problem occurs.

SUMMARY OF THE INVENTION

The invention is, therefore, made in consideration of such a present situation and it is an object of the invention to provide a sheet feeding apparatus and an image forming apparatus in which sheets can be stably separated and fed.

According to the invention, there is provided a sheet feeding apparatus comprising a sheet separation feeding unit which separates and feeds sheets supported in a sheet supporting unit, the sheet separation feeding unit comprises: a feed roller which feeds out the sheets in a sheet feeding direction; a separating roller which is rotatable in a direction opposite to the sheet feeding direction and separates the sheets one by one by a separation nip portion which is formed between the separating roller and the feed roller; and a charge eliminating mechanism which is provided on an upstream side in the sheet feeding direction in the separation nip portion and eliminates charges of the separating roller.

Further features of the present invention will become apparent from the following description of exemplary embodiments with reference to the attached drawings.

DESCRIPTION OF THE EMBODIMENTS

An exemplary embodiment for embodying the invention will be described in detail hereinbelow with reference to the drawings.

Figure 1:
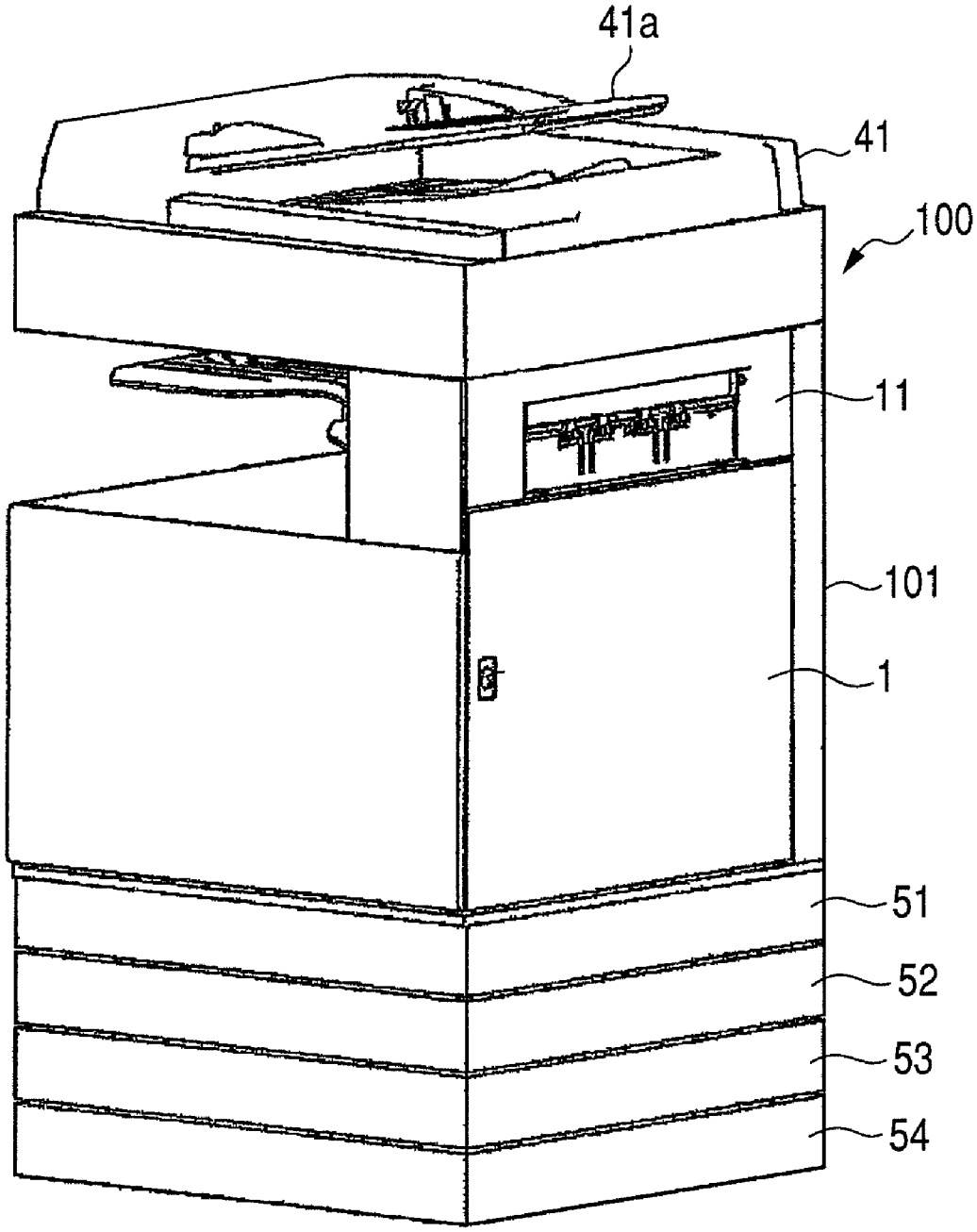
FIG. 1 is a perspective view of a printer as an example of an image forming apparatus having a sheet feeding apparatus according to an embodiment of the invention.
Figure 2:
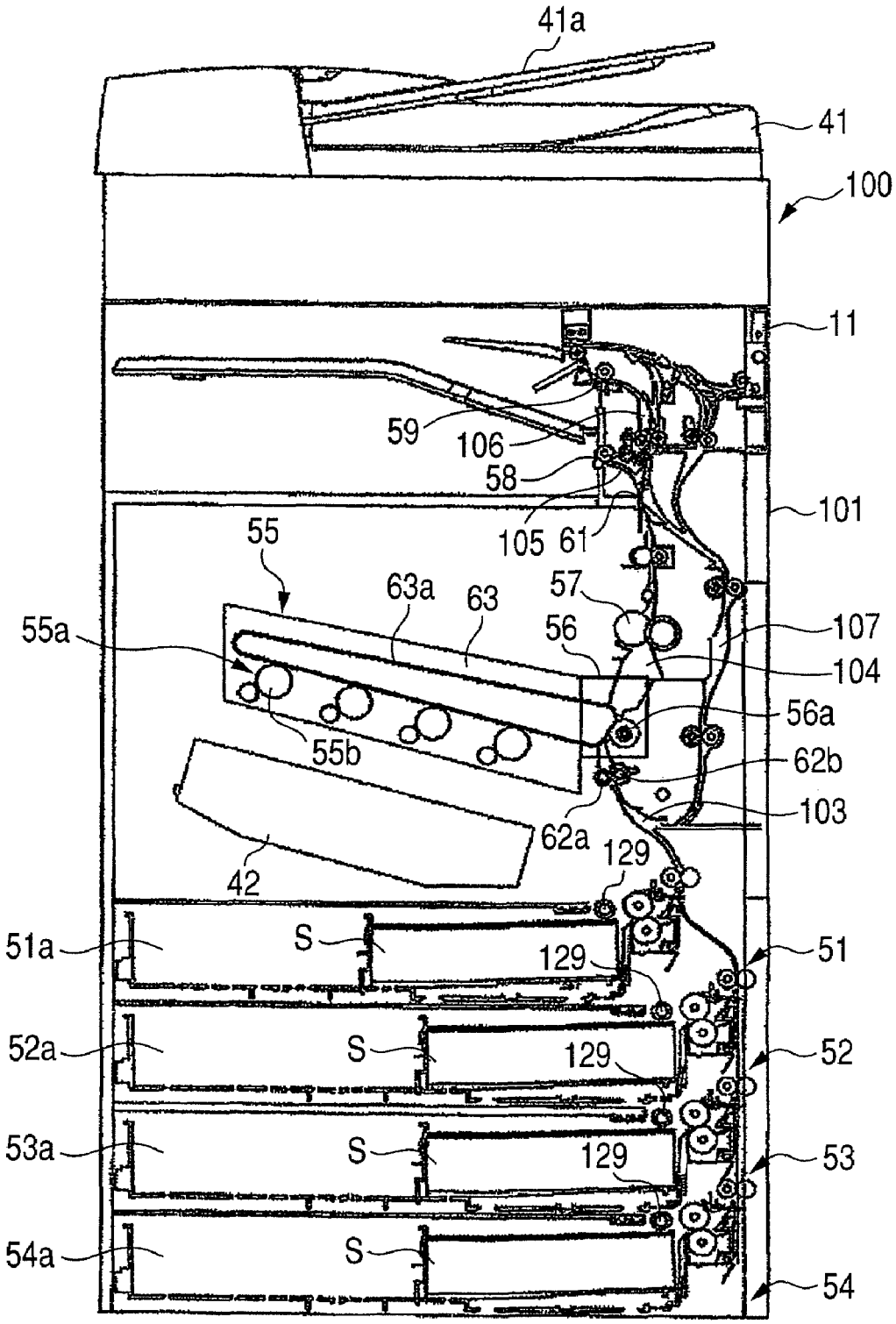
FIG. 2 is a diagram illustrating a schematic construction of the printer.

FIG. 1 is a perspective view of a printer 100 as an example of an image forming apparatus having a sheet feeding apparatus according to the embodiment of the invention. FIG. 2 is a diagram illustrating a schematic construction of the printer.

In FIG. 1, an image reading unit 41 having an image sensor and the like is provided over a printer main body 101. The image reading unit 41 irradiates light to an original document put on platen glass serving as an original setting base plate and converts reflected light into a digital signal. An automatic document feeder (ADF) 41*a* conveys the original onto the platen glass in order to read an image of the original.

As illustrated in FIG. 2, an image forming unit 55 and sheet feeding apparatuses 51 to 54 each for feeding the sheets S to the image forming unit 55 are provided under the image reading unit 41.

The image forming unit 55 has a scanner unit 42 and four process cartridges 55*a* for forming toner images of four colors of yellow (Y), magenta (M), cyan (C), and black (Bk). The image forming unit 55 also has an intermediate transfer unit 63 arranged over the process cartridges 55*a*.

Each of the process cartridges 55*a* has a photosensitive drum 55*b*.

The intermediate transfer unit 63 has primary transfer rollers (not shown) which are provided inside of an intermediate transfer belt 63*a* and are come into contact with the intermediate transfer belt 63*a* at positions where it faces the photosensitive drums 55*b*. By applying a transfer bias of a positive polarity to the intermediate transfer belt 63*a* by the primary transfer roller, the color toner images each having a negative polarity on the photosensitive drum are sequentially multipletransferred onto the intermediate transfer belt 63*a*. Thus, a full color image is formed on the intermediate transfer belt.

A secondary transfer unit 56 has a secondary transfer roller 56*a*. The secondary transfer roller 56*a* is provided at a position where it faces the intermediate transfer belt 63*a* and transfers the full color image formed on the intermediate transfer belt onto the sheet S. A fixing unit 57 is arranged over the secondary transfer roller 56*a*. The sheet feeding apparatuses 51 to 54 have: cassettes 51*a* to 54*a* serving as sheet supporting units each of which holds (encloses) the sheets S; and the pickup rollers 129 each serving as a sheet feeding member for feeding the sheets S enclosed in the cassettes 51*a* to 54*a*.

Figure 3:
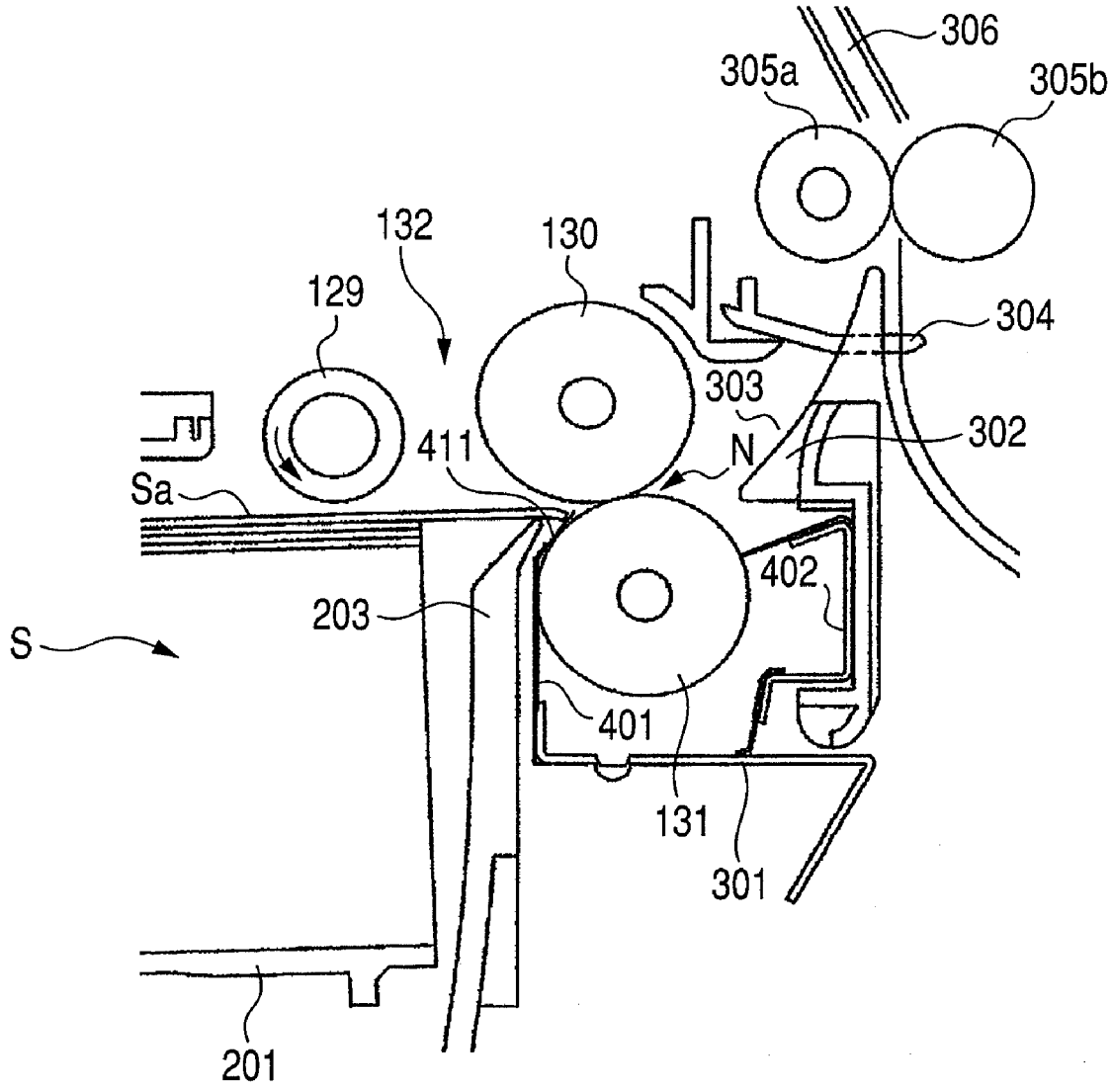
FIG. 3 is a diagram for describing a construction of the sheet feeding apparatus.

As illustrated in FIG. 3, each of the sheet feeding apparatuses 51 to 54 has a sheet separation feeding unit 132 for separating the top sheet Sa fed out by the pickup roller 129.

The sheet separation feeding unit 132 is constructed by: the feed roller 130 for feeding the sheet in the sheet feeding direction; and the retard roller 131 serving as a separating roller which can rotate in the direction opposite to the sheet feeding direction. When the retard roller 131 is come into pressure contact with the feed roller 130 by a spring (not shown), the separation nip portion N is formed between the retard roller 131 and the feed roller 130.

FIG. 3 further illustrates the side wall 203 on the downstream side in the sheet feeding direction of the cassettes 51*a* to 54*a*. The sheet feeding frame 301 holds the spring (not shown) adapted to allow the retard roller 131 to be come into pressure contact with the feed roller 130.

FIG. 2 illustrates: a conveying path 103 for conveying the sheet S fed out of each of the cassettes 51*a* to 54*a* to the transfer unit 56; a conveying path 104 from the transfer unit 56 to the fixing unit 57; a conveying path 105 from the fixing unit 57 to a sheet discharging unit 58 through a flapper 61; and a conveying path 106 from the flapper 61 to a sheet discharging unit 59. A re-conveying path 107 is a path for reversing the obverse and reverse sides of the sheet and guiding again the reversed sheet to the image forming unit in order to form an image onto the reverse surface of the sheet in which the image has been formed on one surface by the image forming unit 55. In FIG. 1, side covers 1 and 11 form a part of the conveying paths 103 to 106. By opening the side covers 1 and 11, the user can remove the jammed sheet on each conveying path.

Subsequently, the image forming operation of the image forming apparatus 100 constructed as mentioned above will be described.

When the image forming operation is started, the scanner unit 42 irradiates a laser beam (not shown) onto the photosensitive drums 55*b* based on image information sent from a personal computer (not shown). The surfaces of the photosensitive drums 55*b* which have uniformly been charged so as to have a predetermined polarity and a predetermined electric potential are sequentially exposed and electrostatic latent images are formed on the photosensitive drums. After that, the electrostatic latent images are developed by the toner of yellow (Y), magenta (M), cyan (C), and black (Bk) and visualized as toner images of yellow (Y), magenta (M), cyan (C), and black (Bk), respectively.

By sequentially transferring the color toner images onto the intermediate transfer belt 63*a* by the primary transfer bias applied to the primary transfer rollers, a full color toner image is formed onto the intermediate transfer belt.

In parallel with the toner image forming operation, the pickup roller 129 conveys the top sheet Sa among the sheets S stored in each of the cassettes 51*a* to 54*a* to the separation nip portion N formed between the feed roller 130 and the retard roller 131. The sheet Sa fed to the separation nip portion N is further conveyed by the feed roller 130 and the retard roller 131 which is driven by the feed roller 130.

After that, the sheet Sa passes along the guide 302 and the conveying path 303, is detected by the detecting sensor flag 304, and reaches the pair of conveying rollers 305*a* and 305*b*. Further, the sheet Sa sandwiched between the pair of conveying rollers 305*a* and 305*b* is conveyed to a conveying path 306 and is come into contact with a pair of registration rollers 62*a* and 62*b* in the stop state, so that a position of the front edge of the sheet is adjusted.

Subsequently, the pair of registration rollers 62*a* and 62*b* are driven at timing for making the full color toner image on the intermediate transfer belt coincide with the position of the sheet S in the secondary transfer unit 56. Thus, the sheet Sa is conveyed to the secondary transfer unit 56. In the secondary transfer unit 56, the full color toner image is transferred onto the sheet Sa in a lump by a secondary transfer bias applied to the secondary transfer roller 56*a*.

Subsequently, the sheet Sa on which the full color toner image has been transferred in this manner is conveyed to the fixing unit 57. In the fixing unit 57, the sheet receives a heat and a pressure and the toner of respective colors is melted, color-mixed, and fixed as a full color image onto the sheet Sa. After that, the sheet Sa on which the image has been fixed in this manner is discharged by the sheet discharging units 58 and 59 provided in the downstream of the fixing unit 57.

Figure 4:
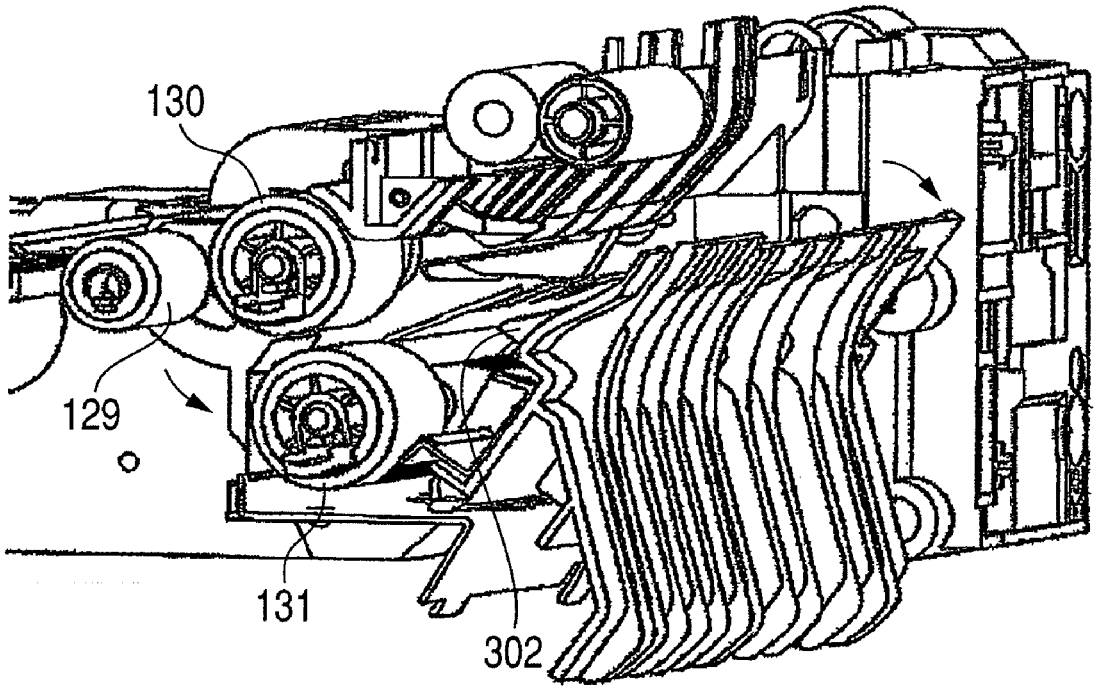
FIG. 4 is a first diagram illustrating a state at the time of executing a jam process of the sheet feeding apparatus.
Figure 5:
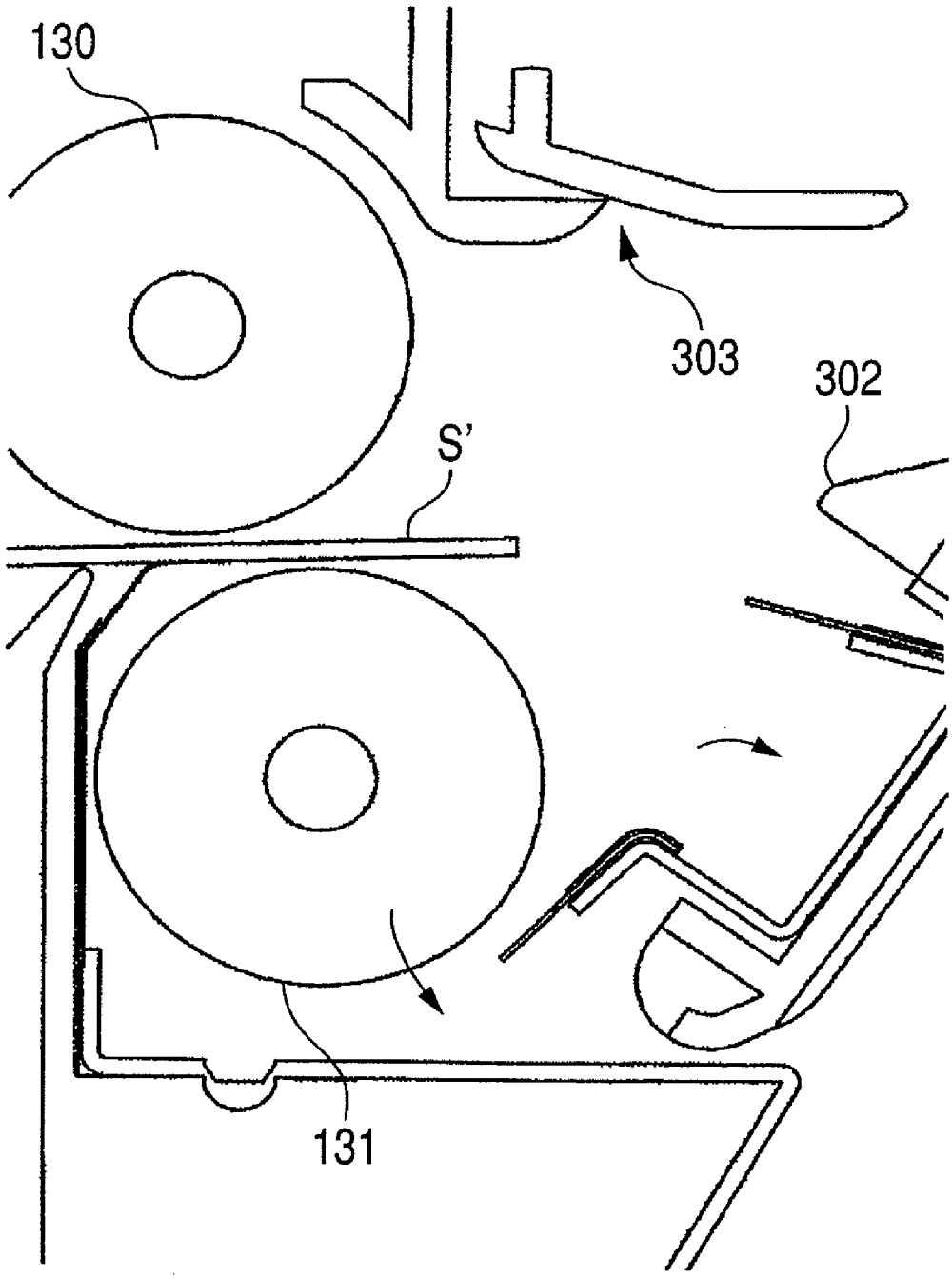
FIG. 5 is a second diagram illustrating a state at the time of executing the jam process of the sheet feeding apparatus.

In the printer 100, there is a case where a jam occurs in the sheet feeding apparatuses 51 to 54. In such a case, first, as illustrated in FIGS. 4 and 5, the retard roller 131 is moved downward and the pressure contact with the feed roller 130 is cancelled by a pressure cancelling mechanism (not shown), thereby setting a jammed sheet S' into a free state. After that, the side covers 1 and 11 (refer to FIG. 1) are opened and the conveying guide 302 is rotated around a rotational center (not shown) as a center, thereby opening the conveying path 303 and processing the jammed sheet S'.

Figure 6:
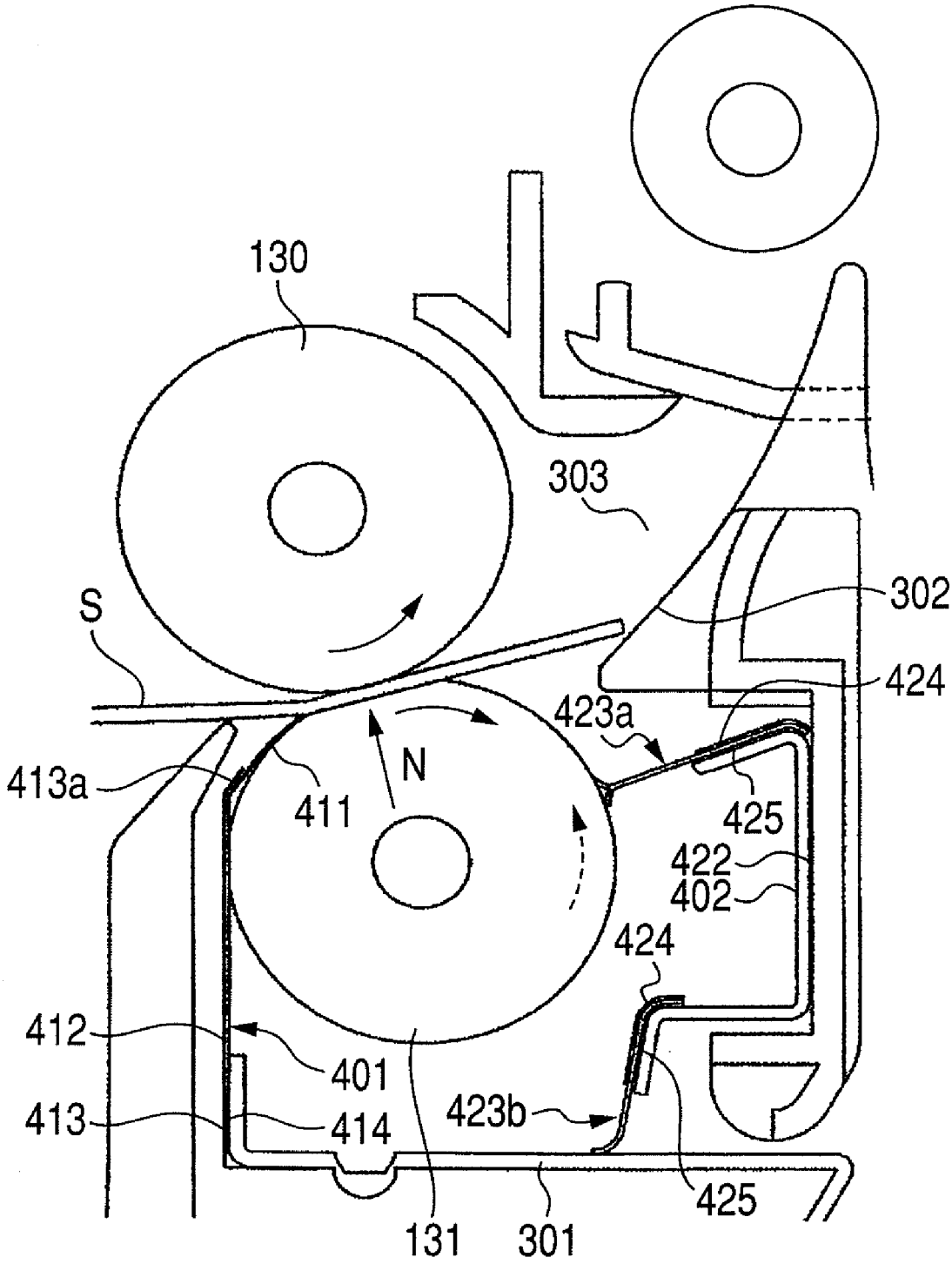
FIG. 6 is a first diagram for describing a construction of a retard roller charge eliminating unit provided for the sheet feeding apparatus.

In FIG. 3, a guide member 411 for guiding the sheet toward the separation nip portion N between the feed roller 130 and the retard roller 131 is provided. The guide member 411 is formed by a conductive sheet having flexibility. As illustrated in FIG. 6, the guide member 411 is adhered to an SUS plate 413 by a conductive double-coated adhesive tape 412 and a front edge portion is bent toward the separation nip portion N.

The SUS plate 413 is adhered to the sheet feeding frame 301 by a double-coated adhesive tape 414. The SUS plate 413 is conductive to the sheet feeding frame 301. The sheet feeding frame 301 is connected to a frame body of a sheet metal of the printer main body 101 through an earth portion (not shown) formed by a sheet metal. By adhering the SUS plate 413 to the sheet feeding frame 301, the guide member 411 is connected to the ground through the sheet feeding frame 301.

The guide member 411 is bent from the halfway to an angle adapted to guide the sheet to a position near the separation nip portion and the front edge is extended to a position near the separation nip portion. However, since the guide member 411 is a thin elastic member, the bending angle is not stable.

In the embodiment, therefore, a backup portion 413*a* is provided for the SUS plate 413 at almost the same position as the portion of the guide member 411 which is bent to the separation nip portion side. By the backup portion 413*a*, the guide member 411 can be pressed so as not to change the bending angle.

Figure 7:
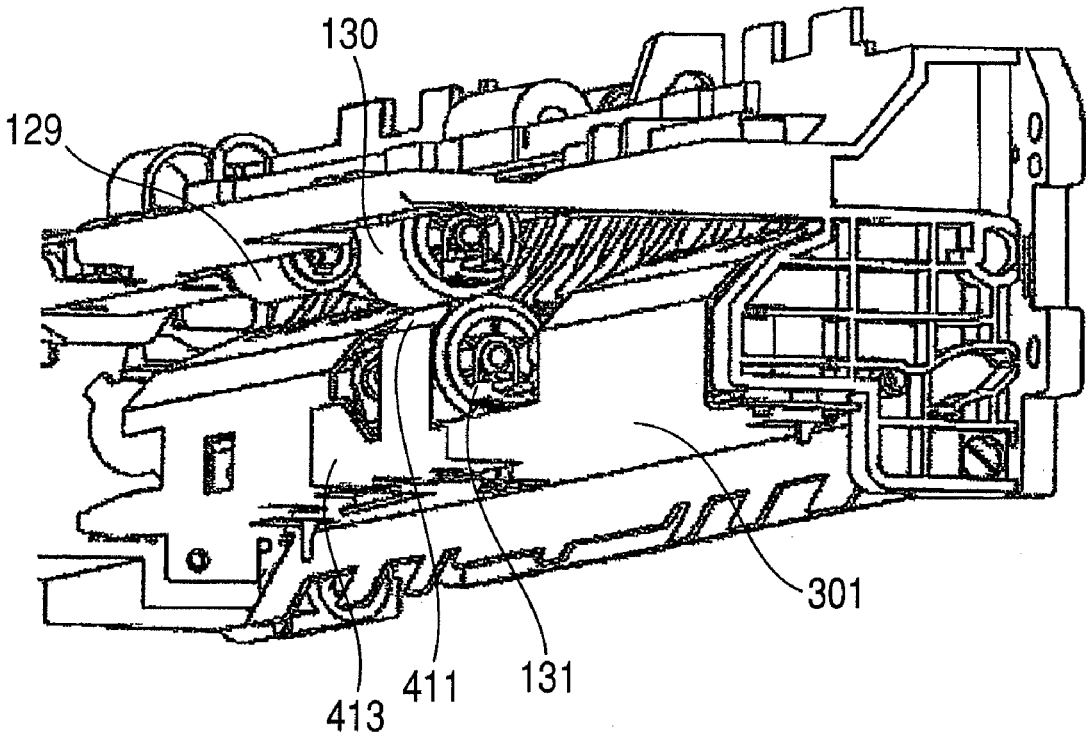
FIG. 7 is a second diagram for describing the construction of the retard roller charge eliminating unit provided for the sheet feeding apparatus.

A charge eliminating unit 401 as a charge eliminating mechanism for eliminating the charges of the retard roller 131 is constructed by the guide member 411, (the backup portion 413*a* of) the SUS plate 413 having the conductivity, the conductive double-coated adhesive tape 412, the sheet feeding frame 301, and the like. The charge eliminating mechanism is arranged on the upstream side in the sheet feeding direction in the separation nip portion N between the feed roller 130 and the retard roller 131. In the embodiment, as illustrated in FIG. 7, the guide member 411 is in plane contact with the outer surface of the retard roller 131, thereby improving charge eliminating performance.

Subsequently, the charge eliminating operation of the retard roller by the charge eliminating unit 401 will be described.

Upon sheet feeding, when the top sheet Sa is fed out by the pickup roller 129, the sheet Sa is conveyed to the separation nip portion N by the guide member 411. At this time, for example, even if the sheet Sa has been curled to the retard roller 131 side, the front edge of the sheet Sa is guided to the separation nip portion N by the guide member 411 without colliding with the retard roller 131.

Since the bending portion of the guide member 411 is supported by the backup portion 413*a* of the SUS plate 413 and the bending angle is stable in this instance, the sheet Sa is certainly guided to the separation nip portion N.

As a sheet Sa fed to the separation nip portion N, if only one sheet has been conveyed to the separation nip portion N, the retard roller 131 is driven by the fed sheet Sa by the operation of the torque limiter as described in the related art. Thus, the sheet Sa passes along the conveying path 303.

On the other hand, if a plurality of sheets has been conveyed to the separation nip portion N, the retard roller 131 is rotated in the direction opposite to the sheet feeding direction of the feed roller 130 by the operation of the torque limiter without being driven by the sheet Sa. Since the retard roller 131 is rotated in the direction opposite to the sheet feeding direction of the feed roller 130 as mentioned above, only one sheet Sa which is in contact with the feed roller 130 is conveyed and other sheets are returned to the upstream side in the sheet feeding direction by the retard roller 131.

After that, the one separated sheet Sa passes along the conveying path 303 illustrated in FIG. 3, is detected by the detecting sensor flag 304, and reaches the pair of conveying rollers 305*a* and 305*b*.

When the sheet passes through the separation nip portion N, the surface of the retard roller 131 is charged by the scrape of the surface or the slide friction of the conveyed sheet Sa. However, even if the roller surface is charged as mentioned above, the static electricity is propagated to the sheet metal frame body of the printer main body 101 through the guide member 411 which is extended toward the separation nip portion N and is come into contact with the retard roller 131, the conductive double-coated adhesive tape 412, the SUS plate 413, the sheet feeding frame 301, and the earth portion (not shown) and is eliminated.

When one sheet is fed, since the retard roller 131 is driven, a charge amount is small. However, when the retard roller 131 is reversely rotated, the charge amount increases. This is because since a plurality of sheets is returned, the slide friction occurs between the sheets and charges are generated. Although the generated charges charge the retard roller 131, since the retard roller 131 is reversely rotated, they are soon eliminated by the guide member 411. In the separation nip portion N, since the charge removal can be performed immediately after the charging of the retard roller 131 as mentioned above, the deposition of the paper powder to the retard roller 131 can be efficiently prevented. By preventing the paper powder or the like of the sheet from being deposited, the sheet can be stably separated and fed.

As illustrated in FIG. 7, since the guide member 411 is in plane contact with the outer surface of the retard roller 131, the charges charged to the sheet flow to the guide member 411 through the sheet or the retard roller 131.

Further, although the feed roller 130 is also charged, the charged charges also flow to the guide member 411 through the sheet and the retard roller 131 and are eliminated.

Although the guide member 411 is in plane contact with the outer surface of the retard roller 131 in the embodiment, even if the guide member 411 is arranged with a gap of a predetermined amount (micro amount) from the outer surface, the charges can be eliminated.

Subsequently, experiment results of the charge removal of the retard roller 131 which has been executed by using the charge eliminating unit 401 according to the embodiment will be described. In the experiment, the charge removal amount of the retard roller 131 is measured under the following conditions in each of the case where there is no guide member, the case where an insulating sheet is used as a guide member, and the case where a conductive sheet is used as a guide member as in the embodiment.

(Conditions)

Conveying sheet: After 50 sheets of Chinese Furaion [FLYING] were allowed to pass Measuring portion: Surface of the retard roller 131

Measuring instrument: AS-mini made by Achilles Corporation (Measurement Values)

Guide member (none): 3.5 to 3.8 kV

Guide member (insulating sheet): 2.7 to 3.0 kV

Guide member (conductive sheet): 1.3 to 1.5 kV

It has been found that the charge amount is reduced into about ½ by using the conductive sheet as a guide member 411 instead of the insulating sheet. Since the charge amount is reduced in this manner, the paper powder is difficult to be adsorbed to the surface of the retard roller 131 and the rapid decrease in coefficient of friction of the surface of the retard roller can be prevented.

As described above, the guide member 411 is formed by the conductive member, the guide member 411 is arranged near the retard roller 131 or is come into contact therewith, and the charges of the retard roller 131 are eliminated, so that the paper powder can be made difficult to be deposited to the retard roller 131. Therefore, the rapid decrease in coefficient of friction of the surface of the retard roller can be prevented. Consequently, the sheet can be stably separated and fed.

In the embodiment, in order to obtain a larger charge eliminating advantage, first and second charge eliminating needles 423*a* and 423*b* are provided as illustrated in FIG. 6 mentioned above.

Each of the first and second charge eliminating needles 423*a* and 423*b* is formed by sandwiching aluminum foil 424 by conductive double-coated coated adhesive tapes 425. The first charge eliminating needle 423*a* is adhered by the conductive double-coated adhesive tape 425 to an upper edge of a charge eliminating needle plate 402 formed by a sheet metal. The second charge eliminating needle 423*b* is adhered to a lower edge of the charge eliminating needle plate 402 by the conductive double-coated adhesive tape 425.

The charge eliminating needle plate 402 is adhered to the conveying guide 302 by a conductive double-coated adhesive tape 422. The upper edge of the charge eliminating needle plate 402 is bent so that a front edge of the first charge eliminating needle 423*a* is vertically come into contact with the outer surface of the retard roller 131. The lower edge of the charge eliminating needle plate 402 is bent so that a front edge of the second charge eliminating needle 423*b* is come into contact with the sheet feeding frame 301.

That is, in the embodiment, the first charge eliminating needle 423*a* is attached to the charge eliminating needle plate 402 so as to be vertically come into contact with the outer surface of the retard roller 131, and the second charge eliminating needle 423*b* is attached to the charge eliminating needle plate 402 so as to be come into contact with the sheet feeding frame 301.

When the sheet is conveyed as mentioned above, in the separation nip portion N, the surface of the retard roller 131 is charged by the slide friction with the conveyed sheet S. However, the charged surface portion is come into contact with the first charge eliminating needle 423*a* in association with the rotation of the retard roller 131. Thus, the charges are eliminated from the first charge eliminating needle 423*a* to the sheet metal frame body of the printer main body 101 through the conductive double-coated adhesive tape 425, the charge eliminating needle plate 402, the conductive double-coated adhesive tape 425, the second charge eliminating needle 423*b*, the sheet feeding frame 301, and the earth portion (not shown).

Figure 8:
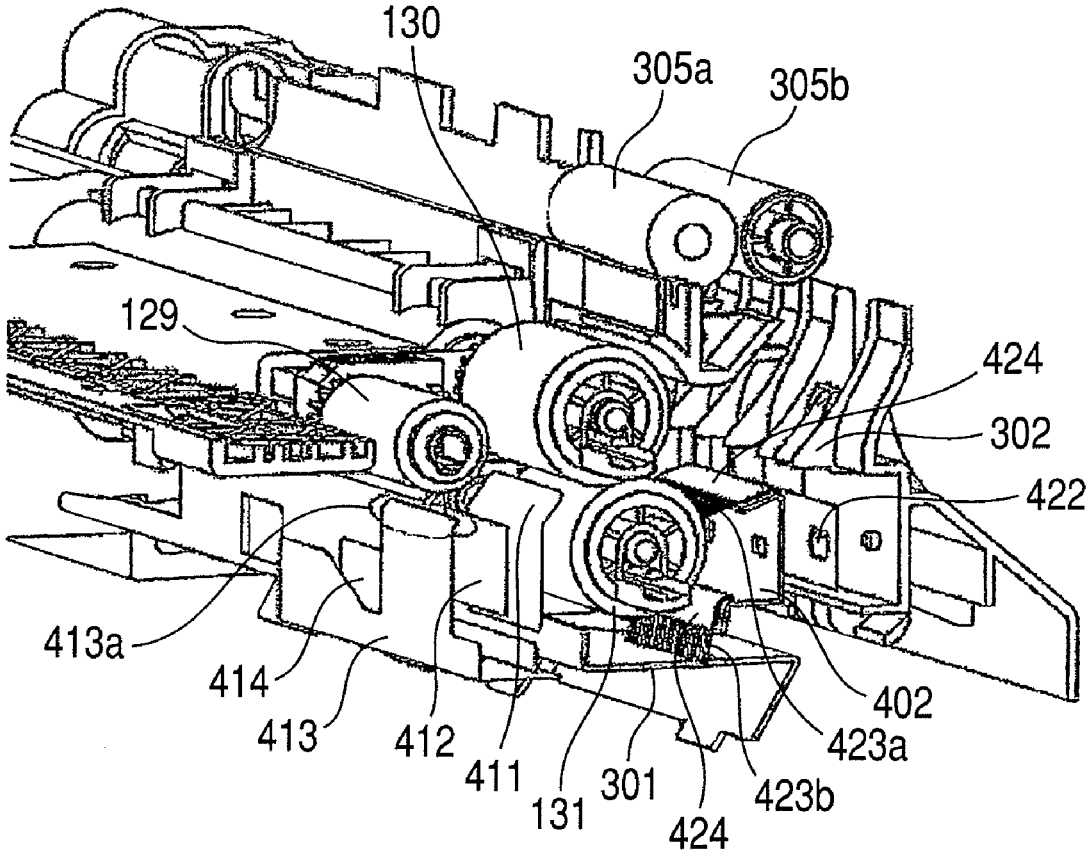
FIG. 8 is a first diagram for describing an attaching state of charge eliminating needles provided for the retard roller charge eliminating unit.
Figure 9:
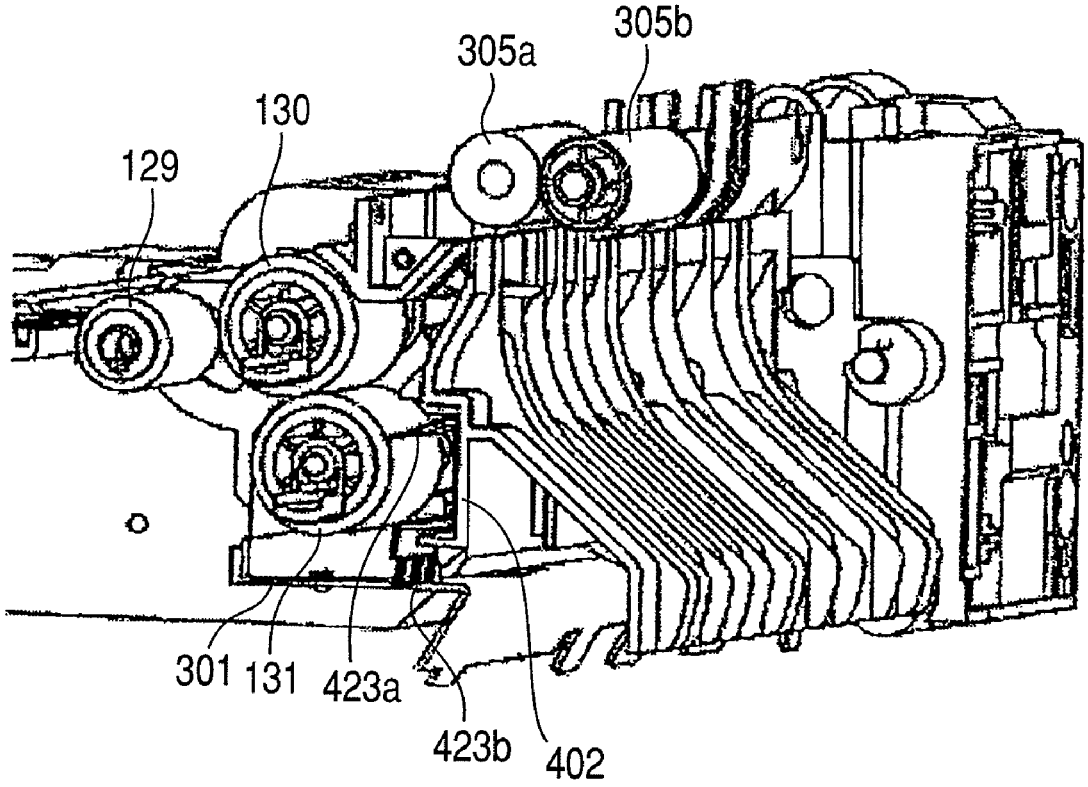
FIG. 9 is a second diagram for describing the attaching state of the charge eliminating needle provided for the retard roller charge eliminating unit.
Figure 10:
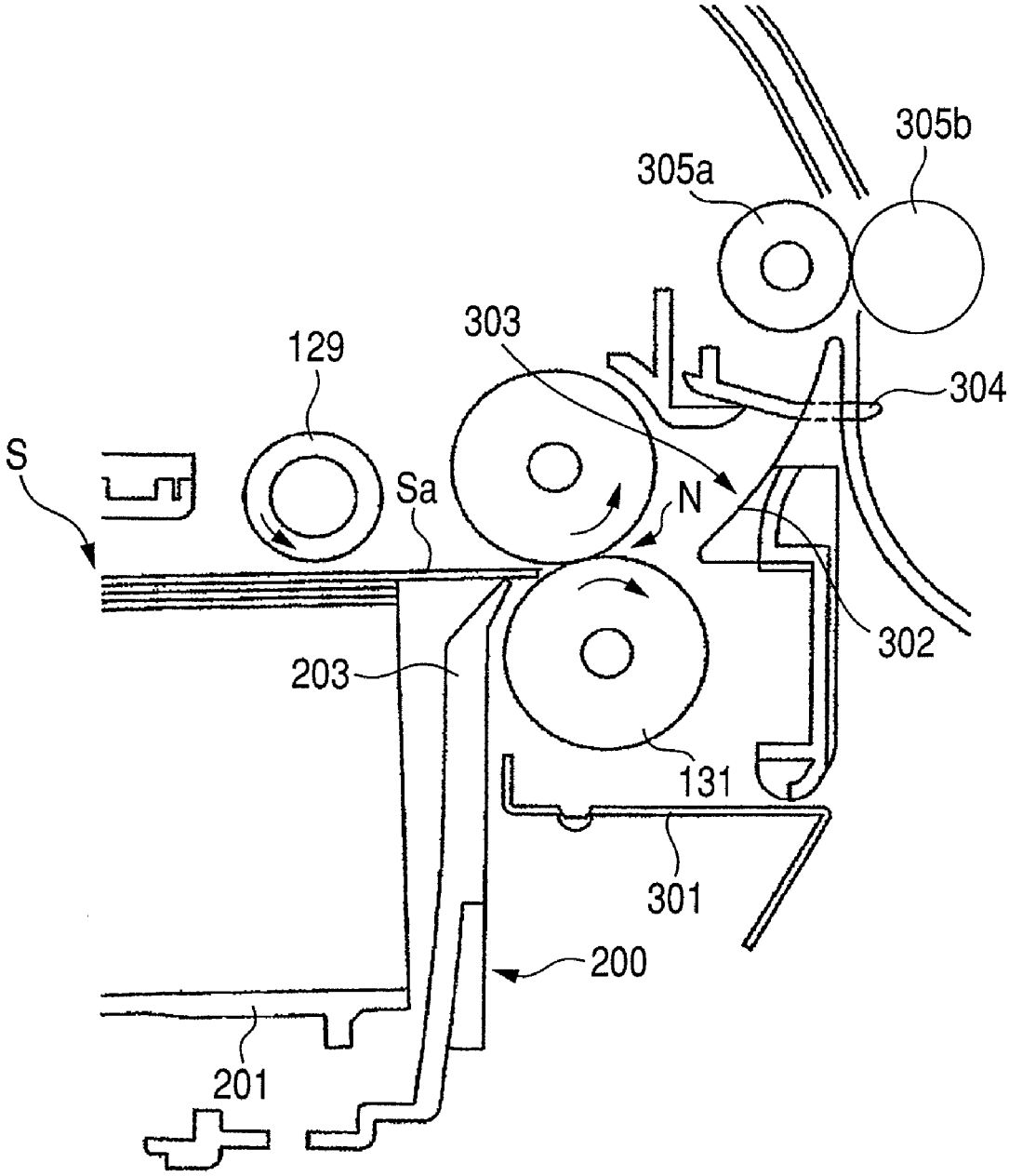
FIG. 10 is a diagram illustrating a construction of a sheet feeding apparatus in the related art.
Figure 11:
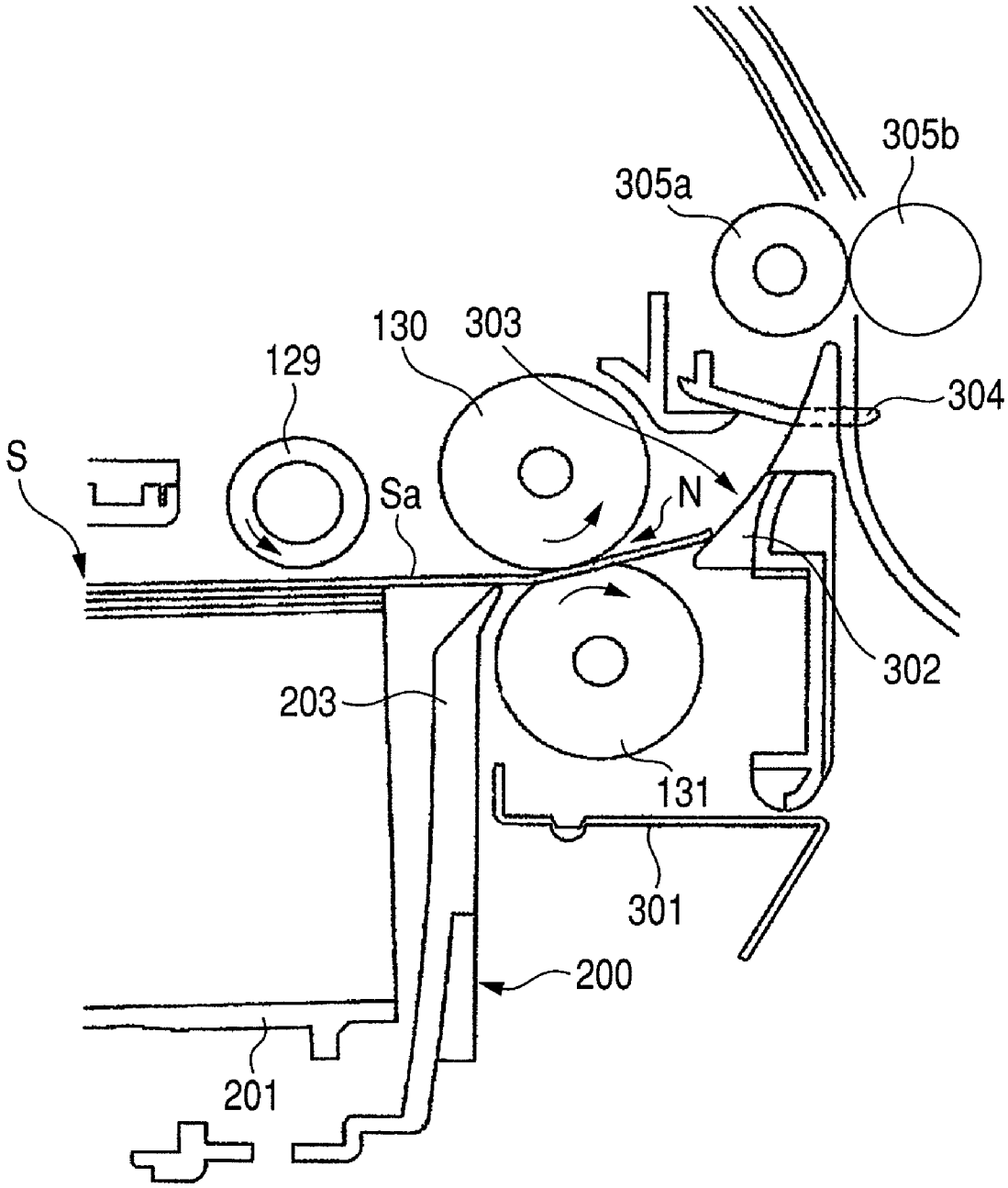
FIG. 11 is a first diagram for describing the sheet separation feeding operation of the sheet feeding apparatus in the related art.
Figure 12:
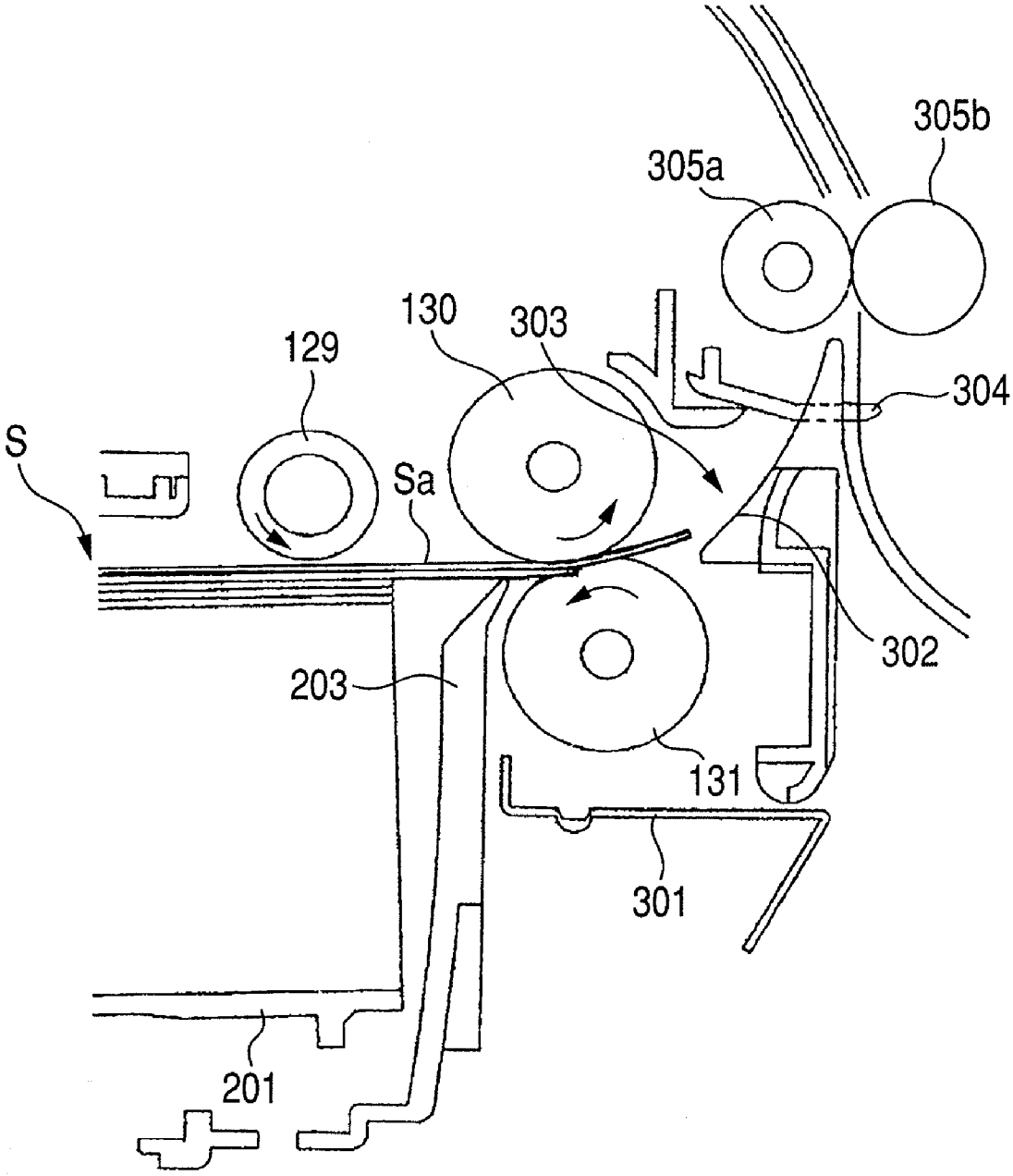
FIG. 12 is a second diagram for describing the sheet separation feeding operation of the sheet feeding apparatus in the related art.
Figure 13:
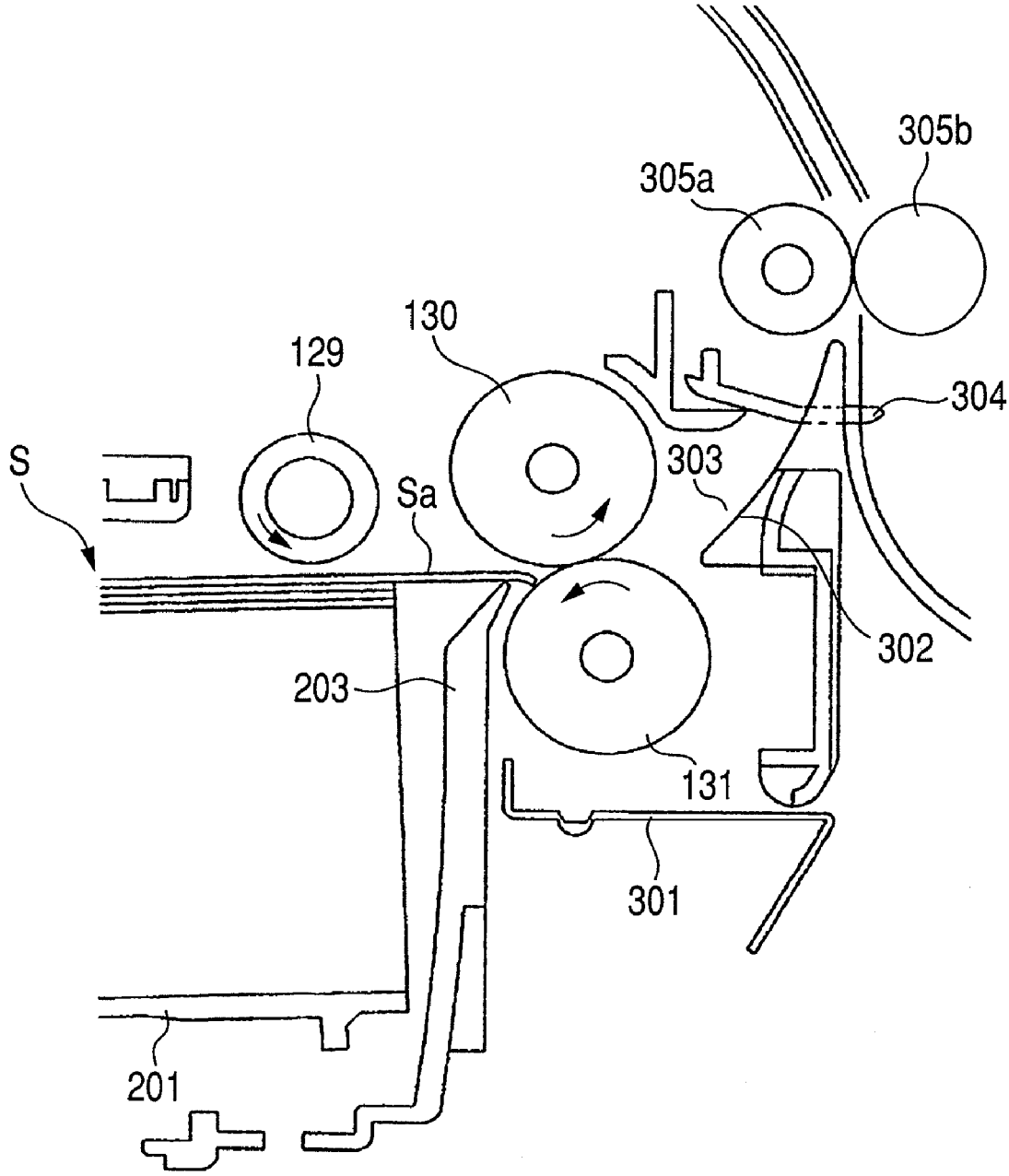
FIG. 13 is a third diagram for describing the sheet separation feeding operation of the sheet feeding apparatus in the related art.
Figure 14:
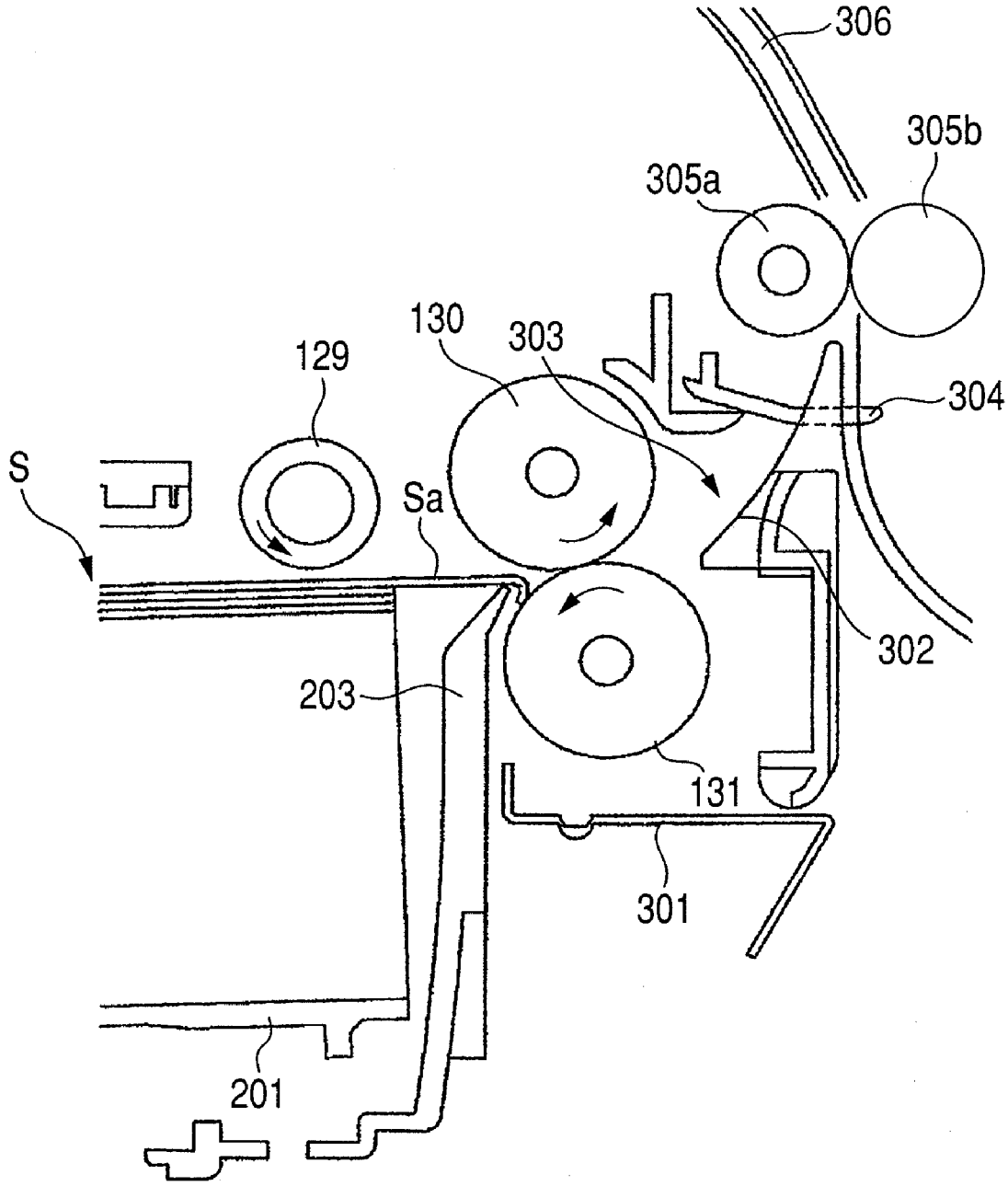
FIG. 14 is a fourth diagram for describing the sheet separation feeding operation of the sheet feeding apparatus in the related art.
Figure 15:
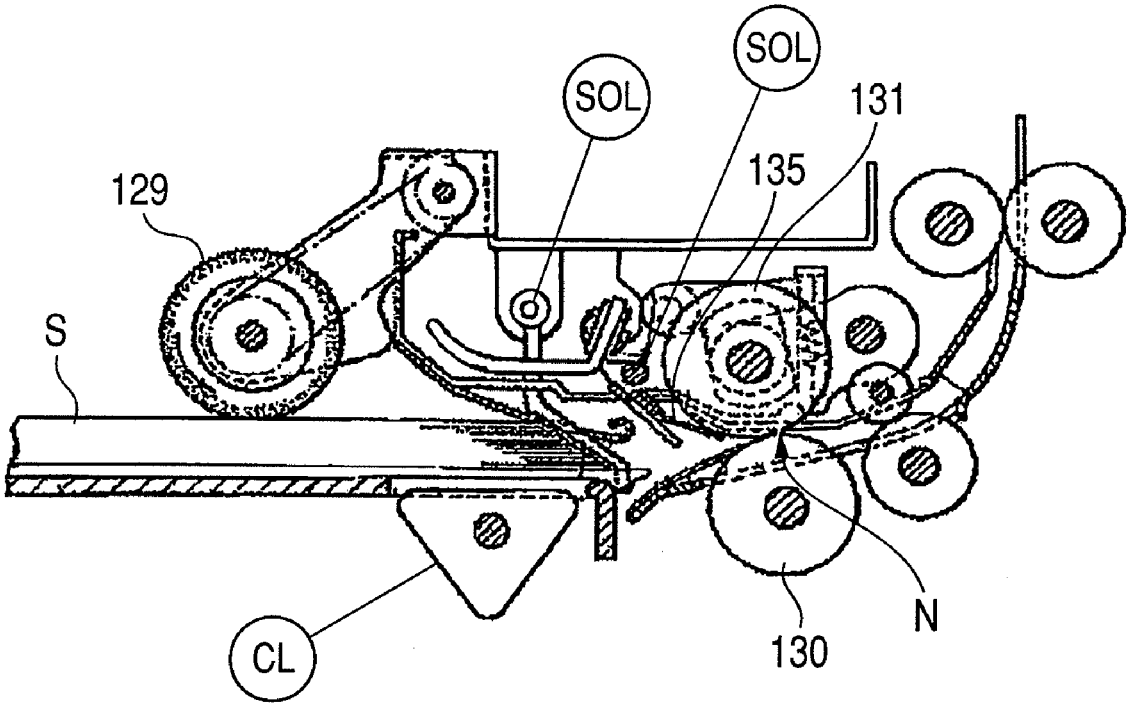
FIG. 15 is a diagram illustrating another sheet feeding apparatus in the related art.

If a plurality of sheets has been conveyed to the separation nip portion N, the retard roller 131 is rotated in the reverse direction as shown by a broken arrow. Therefore, as illustrated in FIGS. 6, 8, and 9, the first charge eliminating needle 423*a* is attached to the charge eliminating needle plate 402 so that the front edge of the needle is come into contact with the outer surface of the retard roller 131 in the vertical direction.

Further, in the embodiment, the first charge eliminating needle 423*a* is attached in such a manner that when the retard roller 131 is rotating in the feeding direction, the front edge of the needle is bent as shown by a solid line in FIG. 6 and, when the retard roller 131 is rotating in the reverse direction, the front edge is bent as shown by a broken line.

Thus, no damage is given to the first charge eliminating needle 423*a* irrespective of the rotating direction of the retard roller 131. When the first charge eliminating needle 423*a* is come into contact with the outer surface of the retard roller 131, the higher charge eliminating performance is obtained. However, even if the first charge eliminating needle 423*a* is arranged with a gap of a predetermined amount from the outer surface, the charges can be eliminated.

Subsequently, experiment results of the charge removal of the retard roller 131 which has been executed by using the charge eliminating unit 401 in the case of using such charge eliminating needles will be described. In the experiment, the charge removal amount of the retard roller 131 in the case of using the conductive sheet as a guide member is measured under the following conditions.

(Conditions)

Conveying sheet: After 50 sheets of Chinese Furaion [FLYING] were allowed to pass Measuring portion: Surface of the retard roller 131

Measuring instrument: AS-mini made by Achilles Corporation (Measurement Value)

Guide member (conductive sheet)+charge eliminating needles: 0.1 to 0.2 kV

By adding the charge eliminating needles as mentioned above, the charge amount is reduced into almost 0 kV. Since the charge amount is reduced in this manner, the paper powder is difficult to be adsorbed to the surface of the retard roller 131 and the rapid decrease in coefficient of friction of the surface of the retard roller can be prevented.

The invention is not limited to the foregoing embodiment. Although the embodiment has been shown with respect to the example in which the guide member is constructed by the conductive sheet having the flexibility, such a construction that a flexible member is coated with a conductive material can be also used. That is, as a guide member, an arbitrary guide member may be used so long as it has a structure with the conductivity.

Although the guide member as a feature of the invention has been applied to the construction in which the sheets are fed out of each of the cassettes 51*a* to 54*a* by the pickup roller 129 and the sheets are separated by the feed roller 130 and the retard roller 131 in the embodiment, the invention is not limited to such a construction.

For example, the guide member of the invention may be applied to a construction of a sheet separation feeding unit in which the sheets stacked and supported on a tray are fed out by a feed roller without using the pickup roller and, further, separated by the retard roller which is come into pressure contact with the feed roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-114870, filed Apr. 24, 2007, which is hereby incorporated by reference herein in its entirety.

What is claimed is:

1. A sheet feeding apparatus comprising a sheet separation feeding unit which separates and feeds sheets supported in a sheet supporting unit, the sheet separation feeding unit comprising:

a feed roller which feeds out the sheets in a sheet feeding direction;

a separating roller which is rotatable in a direction opposite to the sheet feeding direction and separates the sheets one by one by a separation nip portion which is formed between the separating roller and the feed roller; and a charge eliminating mechanism which is provided on an upstream side in the sheet feeding direction in the separation nip portion and eliminates charges of the separating roller, wherein the charge eliminating mechanism has a guide member which guides the sheets supported in the sheet supporting unit toward the separation nip portion; and the guide member comprises a flexible conductive sheet, and the guide member is arranged in contact with a surface of the separating roller or is arranged in contact with a surface of the separating roller or is arranged with a predetermined gap, and is connected to a ground, thereby eliminating the charges of the separating roller through the guide member.

2. An apparatus according to claim 1, wherein the guide member has a bending portion which is bent toward the separation nip portion side, comprises a conductive member which holds a bending angle of the bending portion of the guide member, and has a backup portion connected to the ground.

3. An apparatus according to claim 2, wherein the guide member is adhered to the backup portion by a conductive double-coated adhesive tape.

4. An apparatus according to claim 1, further comprising a charge eliminating needle which approaches or is come into contact with a surface of the separating roller in a vertical direction.

5. A sheet feeding apparatus comprising a sheet separation feeding unit which separates and feeds sheets supported in a sheet supporting unit, the sheet separation feeding unit comprising:

a feed roller which feeds out the sheets in a sheet feeding direction;

a separating roller which is rotatable in a direction opposite to the sheet feeding direction and separates the sheets one by one by a separation nip portion which is formed between the separating roller and the feed roller; and a charge eliminating mechanism which is provided on an upstream side in the sheet feeding direction in the separation nip portion and eliminates charges of the separating roller, wherein the charge eliminating mechanism has a guide member which guides the sheets supported in the sheet supporting unit toward the separation nip portion; and the guide member has a conductivity, is arranged in contact with a surface of the separating roller or is arranged with a predetermined gap, and is connected to a ground, thereby eliminating the charges of the separating roller through the guide member, and wherein the guide member comes into plane contact with an outer periphery of the separating roller.

6. An image forming apparatus comprising a sheet separation feeding unit which separates and feeds sheets supported in a sheet supporting unit and an image forming unit which forms an image onto the sheet fed out of the sheet separation feeding unit, the sheet separation feeding unit comprises:

a feed roller which feeds out the sheets in a sheet feeding direction;

a separating roller which is rotatable in a direction opposite to the sheet feeding direction and separates the sheets one by one by a separation nip portion which is formed between the separating roller and the feed roller; and a charge eliminating mechanism which is provided on an upstream side in the sheet feeding direction in the separation nip portion and eliminates charges of the separating roller, wherein the charge eliminating mechanism has a guide member which guides the sheets supported in the sheet supporting unit toward the separation nip portion; and the guide member comprises a flexible conductive sheet, and the guide member is arranged in contact with a surface of the separating roller or is arranged with a predetermined gap, and is connected to a ground, thereby eliminating the charges of the separating roller through the guide member.

7. An apparatus according to claim 6, wherein the guide member has a bending portion which is bent toward the separation nip portion side, comprises a conductive member which holds a bending angle of the bending portion of the guide member, and has a backup portion connected to the ground.

8. An apparatus according to claim 7, wherein the guide member is adhered to the backup portion by a conductive double-coated adhesive tape.

9. An apparatus according to claim 6, further comprising a charge eliminating needle which approaches or is come into contact with a surface of the separating roller in a vertical direction.

10. An image forming apparatus comprising a sheet separation feeding unit which separates and feeds sheets supported in a sheet supporting unit and an image forming unit which forms an image onto the sheet fed out of the sheet separation feeding unit, the sheet separation feeding unit comprising:

a feed roller which feeds out the sheets in a sheet feeding direction;

a separating roller which is rotatable in a direction opposite to the sheet feeding direction and separates the sheets one by one by a separation nip portion which is formed between the separating roller and the feed roller; and a charge eliminating mechanism which is provided on an upstream side in the sheet feeding direction in the separation nip portion and eliminates charges of the separating roller, wherein the charge eliminating mechanism has a guide member which guides the sheets supported in the sheet supporting unit toward the separation nip portion; and the guide member has a conductivity, is arranged in contact with a surface of the separating roller or is arranged with a predetermined gap, and is connected to a ground, thereby eliminating the charges of the separating roller through the guide member, and wherein the guide member comes into plane contact with an outer periphery of the separating roller.

* * * * *